US007548206B2

(12) United States Patent
Hong

(10) Patent No.: US 7,548,206 B2
(45) Date of Patent: Jun. 16, 2009

(54) FILM TYPE ANTENNA AND MOBILE COMMUNICATION TERMINAL CASE USING THE SAME

(75) Inventor: Ha Ryong Hong, Gyunggi-do (KR)

(73) Assignee: Samsung Electro-Mechanics Co., Ltd., Suwon, Gyunggi-Do (KR)

( * ) Notice: Subject to any disclaimer, the term of this patent is extended or adjusted under 35 U.S.C. 154(b) by 98 days.

(21) Appl. No.: 11/754,038

(22) Filed: May 25, 2007

(65) Prior Publication Data

US 2008/0158093 A1 Jul. 3, 2008

(30) Foreign Application Priority Data

Jan. 2, 2007 (KR) ..... 10-2007-0000277

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/700 MS, 343/702, 872, 846
See application file for complete search history.

(56) References Cited

U.S. PATENT DOCUMENTS 6,028,555 A 2/2000 Harano
6,396,444 B1 * 5/2002 Goward et al. ..... 343/702
2005/0001767 A1 1/2005 Wulff et al.
2005/0001775 A1 * 1/2005 Liang et al. ..... 343/702

FOREIGN PATENT DOCUMENTS

| | | | |
|---|---|---|---|
| EP | 1 686 651 | A3 | 8/2006 |
| EP | 1 855 514 | A1 | 11/2007 |
| EP | 1 868 263 | A1 | 12/2007 |
| GB | 2 345 196 | A | 6/2000 |
| JP | 2002-372591 | A | 12/2002 |
| JP | 2003-234668 | A | 8/2003 |
| JP | 2005-190064 | A | 7/2005 |
| WO | 2007019762 | A1 | 2/2007 |

OTHER PUBLICATIONS

Korean Intellectual Property Office Search Report mailed Sep. 11, 2007.
English Translation of UK Intellectual Property Office Search Report mailed Apr. 8, 2008.

* cited by examiner

*Primary Examiner*—Hoang V Nguyen
(74) *Attorney, Agent, or Firm*—Lowe Hauptman Ham & Berner

(57) ABSTRACT

A film antenna includes a carrier film made of an insulation material, a conductive radiator formed on a surface of the carrier film, and a first protective layer covering the radiator on the surface of the carrier film. The first protective layer contains a material obstructing X-ray transmission.

20 Claims, 5 Drawing Sheets

(a)

(b)

(a)

(b)

(a)

(b)

FILM TYPE ANTENNA AND MOBILE COMMUNICATION TERMINAL CASE USING THE SAME

CLAIM OF PRIORITY

This application claims the benefit of Korean Patent Application No. 2007-0000277 filed on Jan. 2, 2007, in the Korean Intellectual Property Office, the disclosure of which is incorporated herein by reference.

BACKGROUND OF THE INVENTION

1. Field of the Invention

The present invention relates to a film type antenna and, more particularly, to a film type antenna integrated with a mobile communication terminal case, and a mobile communication terminal case using the same.

2. Description of the Related Art

As mobile communication terminals such as GPS, PDAs, cellular phones, wireless notebook computers and the like have been widely popularized, there have been increasing demands for miniaturization. In order to meet such needs for miniaturization, the main focus has been maintaining diverse functions while reducing the volume of the mobile communication terminals. This has been especially the case for the antenna which is an essential component of a mobile communication terminal.

In general, among the antennas of the mobile communication terminals, external type antennas such as a rod antenna and a helical antenna are protruded in a predetermined length out of the terminal, hindering miniaturization and portability of the terminal. In addition, when the mobile communication terminal is dropped, this type of antenna is more likely to be destructed.

On the contrary, built-in antennas mounted inside mobile communication terminals have reduced risk of destruction, but miniaturization can also be a problem due to their physical size.

Recently, methods of forming the radiator of the antenna directly in a terminal case or an antenna base have been employed to promote maximal utilization of space.

FIG. 1(*a*) is a perspective view illustrating a conventional internal type antenna for a mobile communication terminal, and FIG. 1(*b*) is a schematic sectional view illustrating the internal type antenna mounted inside the mobile communication terminal.

Referring to FIG. 1(*a*), a base 11 made of a plastic material for internal type antennas and a radiator 13 of a patterned metal plate are fabricated, respectively, via injection and pressing, and then integrated together by fusion bonding.

However, this method limits miniaturization as the antenna requires a space to be mounted inside the mobile communication terminal.

The radiator 13 can be formed on the base 11 via printing conductive ink. However, as the antenna base is made of a plastic material, the procedure should be implemented at a temperature that does not cause deformation of the plastic material. Therefore, the antenna pattern should be printed using a low-temperature paste, thus limiting selection of the material because the paste should be selected in consideration of printability, adhesive property, etc.

In addition, to enhance the printability and adhesive quality of the conductive ink, the conductive ink contains conductive material as well as organic substances. Thus, when the conductive ink is treated at a high temperature, the organic substances are eliminated but when treated at a low temperature, the organic substances remain in the ink. The base of the antenna is made of a polymer-based material, hindering high temperature treatment, and as a result, the organic substances contained in the conductive ink remain even after the antenna radiator is formed. This results in low electric conductivity of the antenna radiator, problematically degrading the radiation characteristics of the antenna.

Furthermore, such an antenna pattern can easily be recognized by naked eyes or can easily be appropriated by a competitor via laser irradiation.

SUMMARY OF THE INVENTION

The present invention has been made to solve the foregoing problems of the prior art and therefore an aspect of the present invention is to provide a film type antenna integrally assembled with a mobile communication terminal case, thereby providing a structure that does not expose a radiator of the film type antenna.

According to an aspect of the invention, the invention provides a film type antenna which includes a carrier film made of an insulation material, the carrier film having first and second faces defining a thickness therebetween; a conductive radiator formed on the first surface of the carrier film; and a first protective layer covering the radiator on the first face of the carrier film, the first protective layer containing a material obstructing X-ray transmission.

The film type antenna may further include a second protective layer formed on the second face of the carrier film, corresponding to the first protective layer. At this time, the first and second protective layers may be made of the same material.

It is preferable that the first protective layer may be made of Sn as a main material, and the first protective layer may have the same color as the conductive radiator.

The first protective layer may include an electrically insulating lower layer used as an intermediate layer for forming a plating layer; a Sn plating layer formed on the lower layer; and an electrically insulating upper layer formed on the plating layer.

According to another aspect of the invention, the invention provides a mobile communication terminal case which includes a film type antenna having a carrier film made of an insulation material, the carrier film having first and second faces defining a thickness therebetween, a conductive radiator formed on the first face of the carrier film, and a first protective layer covering the radiator on the first surface of the carrier film, the first protective layer containing a material obstructing X-ray transmission; and a case structure with the film type antenna attached on a surface thereof, wherein the radiator is disposed between the case structure and the carrier film.

According to another aspect of the invention, the invention provides a method of fabricating a mobile communication terminal case. The method includes preparing a carrier film made of an insulation material, the carrier film having first and second faces defining a thickness therebetween; forming a conductive radiator on the first face of the carrier film; forming a first protective layer covering the radiator on the first face of the carrier film; inserting the carrier film with the radiator and the first protective layer formed thereon into a mold having a shape of a case structure; and injecting a molding material into the mold to form a case structure integrated with the carrier film.

The method may further include forming a second protective layer with the same material as the first protective layer on a portion of the second face of the carrier film corresponding to the portion with the conductive radiator formed thereon prior to the step of inserting the carrier film with the radiator and the first protective layer formed thereon into a mold.

The step of forming the conductive radiator may include a sputtering process.

The step of forming a first protective layer may include forming an electrically insulating lower layer on the carrier film to cover the conductive radiator; forming a Sn plating layer on the electrically insulating lower layer; and forming an electrically insulating upper layer on the Sn plating layer.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1:
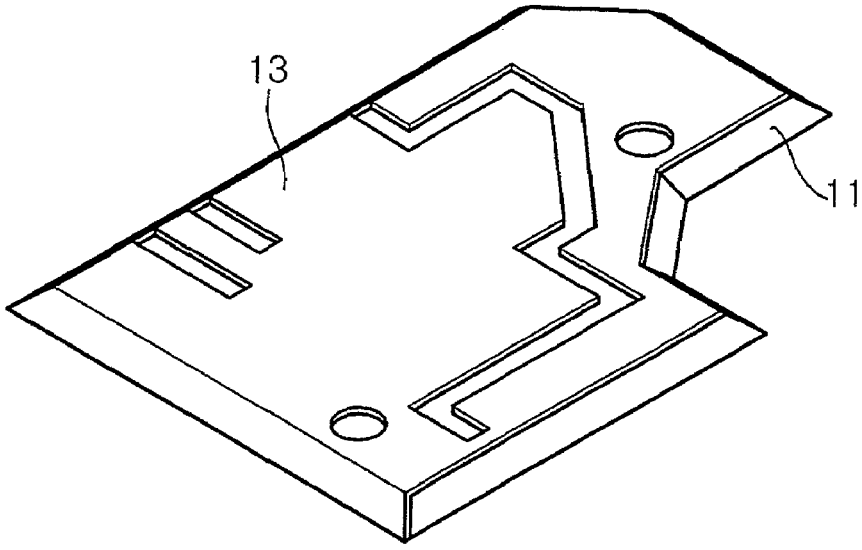
Prior art FIG. 1
FIGS. 1(*a*) and 1(*b*) are a schematic perspective view of a conventional internal type antenna and a schematic sectional view of a terminal with the internal type antenna mounted therein, respectively.
Figure 1:
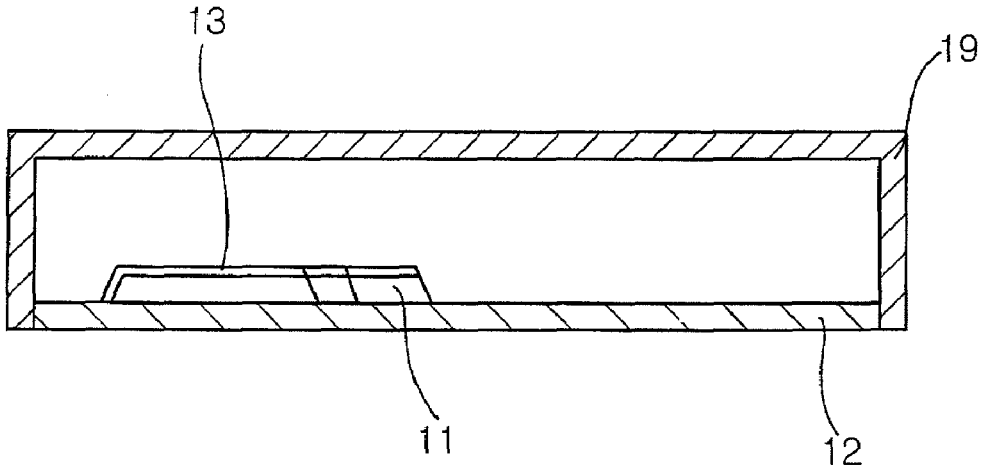
Prior art FIG. 1
Figure 2:
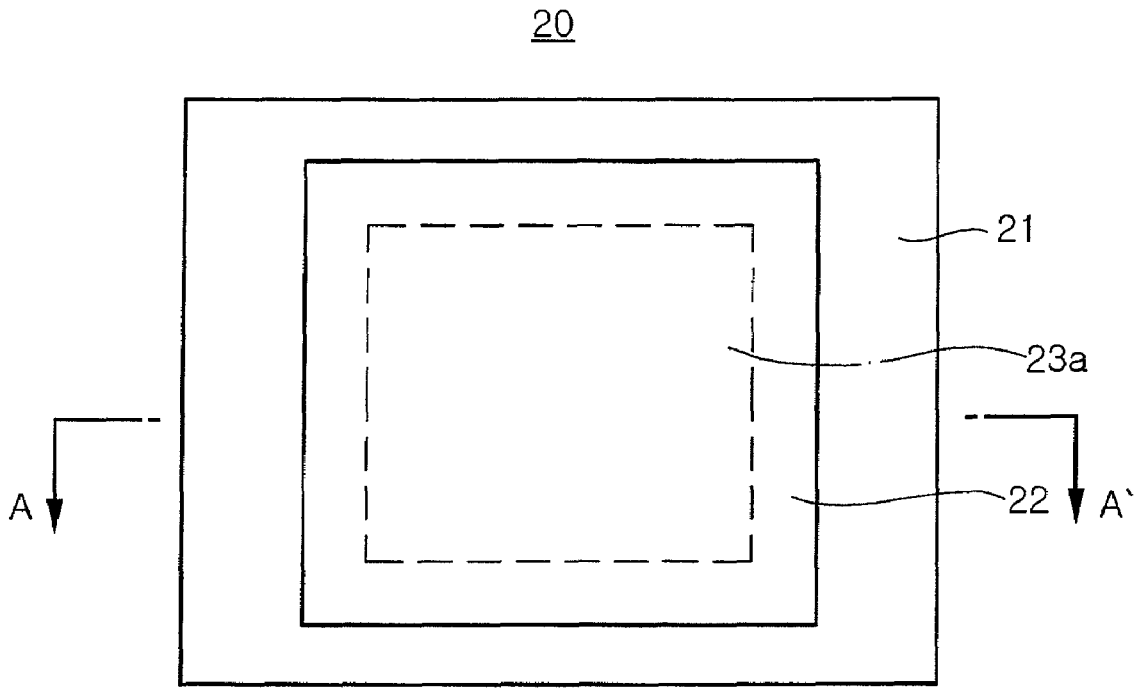
FIGS. 2(*a*) and 2(*b*) are a plan view and a sectional view, respectively, illustrating a film type antenna according to an exemplary embodiment of the present invention.
Figure 2:
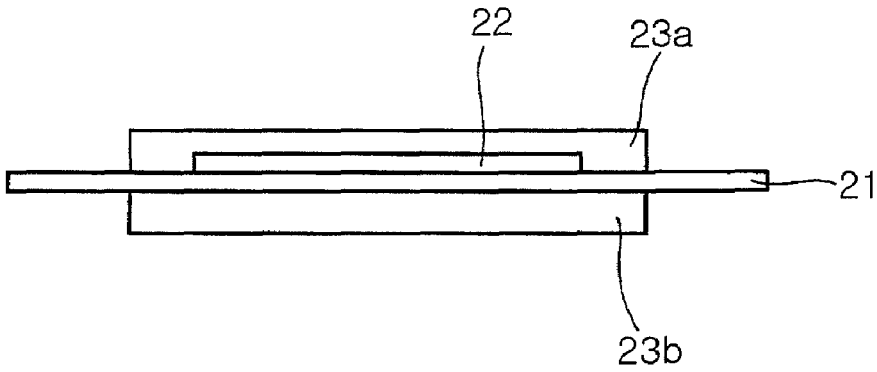

FIGS. 2(*a*) and 2(*b*) are a plan view and a sectional view, respectively, illustrating a film type antenna according to an exemplary embodiment of the present invention.

Referring to FIGS. 2(*a*) and 2(*b*), the film type antenna according to an embodiment of the present invention includes a carrier film 21 having first and second faces defining a thickness therebetween, a radiator 22 formed on the first face of the carrier film 21, a first protective layer 23*a* formed on the first face of the carrier film 21 and a second protective layer 23*b* formed on the second face of the carrier film 21.

The carrier film 21 can be made of a thin insulation polymer material. The carrier film can be made by selecting a material suitable for In-molding Labeling (IML).

More specifically, the carrier film with the radiator and the first and second protective layers formed thereon is inserted in a mold for fabricating a mobile communication terminal. As a synthetic resin is injected in the mold, a body of the mobile communication terminal is molded at suitable temperature and pressure. Thus, for the carrier film 21, it is preferable to use a material that is not largely deformed by the pressure and temperature during the molding process, but readily integrated with the mobile communication terminal case.

The radiator 22 is formed on the first surface of the carrier film 21.

The radiator 22 can be formed by attaching a pre-fabricated conductor pattern on the carrier film 21, and printing with a conductive paste or sputtering. In addition, although not clearly shown in the drawing, the radiator 22 has a feeder and a ground, which can be connected to a power source outside.

Each of the first protective layer 23*a* and the second protective layer 23*b* can be made of a material that can prevent X-ray transmission, and may be made of Sn as a main material in this embodiment. Other than Sn, various materials that do not largely interfere with the functions of the radiator while preventing X-ray transmission can be used.

Forming the protective layers with Sn can prevent X-rays from passing through the pattern of the radiator 22. In addition, by making the protective layers in the same color as the radiator, the radiator pattern can be prevented from being visually recognized from the outside.

Each of the first protective layer 23*a* and the second protective layer 23*b* may be configured to include an electrically insulating lower layer used as an intermediate layer for forming a plating layer, a Sn plating layer formed on the electrically insulating lower layer, and an electrically insulating upper layer formed on the Sn plating layer.

Figure 3:
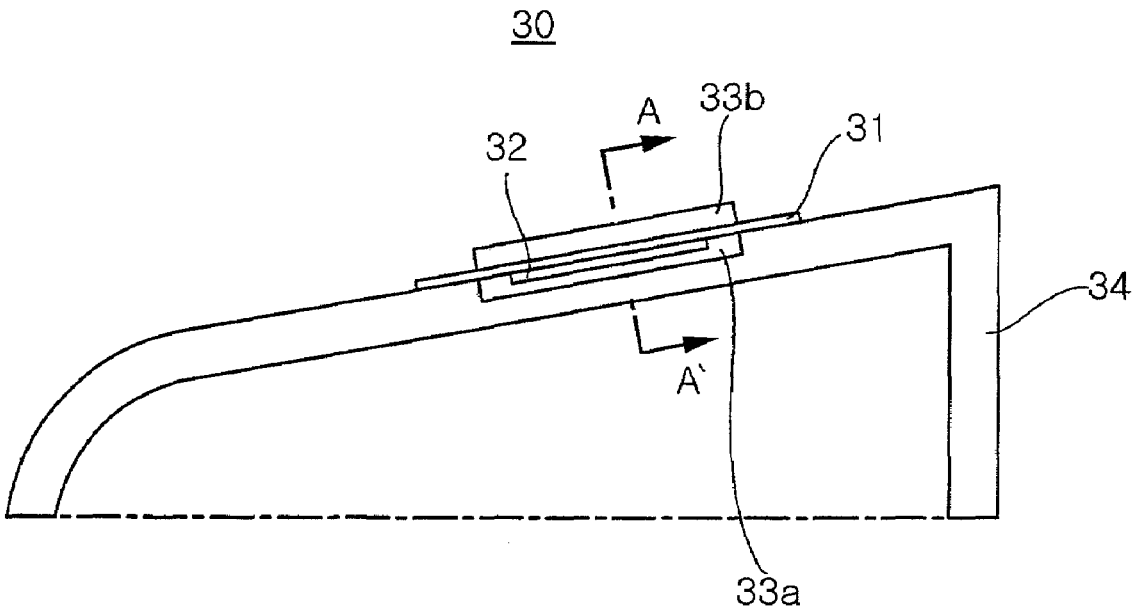
FIGS. 3(*a*) and 3(*b*) are a side sectional view and a front sectional view, respectively, illustrating a mobile communication terminal case with the film type antenna of FIG. 2 attached thereon.
Figure 3:
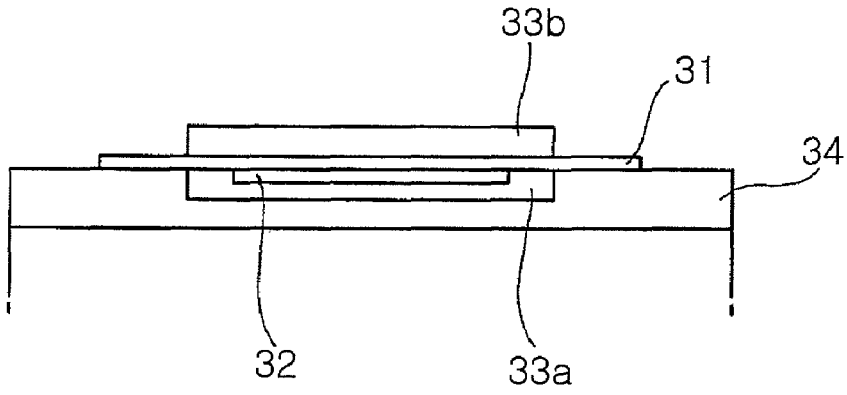

FIGS. 3(*a*) and 3(*b*) are a side sectional view and a front sectional view, respectively, illustrating a mobile communication terminal case with the film type antenna of FIG. 2 attached thereon.

Referring to FIGS. 3(*a*) and 3(*b*), in the mobile communication terminal 30 according to this embodiment, the carrier film 31 with the radiator 32 and the protective layers 33*a* and 33*b* formed thereon is formed integrally with the mobile communication terminal case 34.

The radiator 32 is disposed between the mobile communication terminal case 34 and the carrier film 31.

As described above, the conventional built-in antenna requires a mounting space therein, whereas the film type antenna is formed integrally with a mobile communication terminal according to the present invention, advantageously reducing the mounting space of the antenna in the terminal.

In this embodiment, the film type antenna is attached on an outer surface of the mobile communication terminal case. In this case, the second protective layer 33*b* functions to hinder recognition of the pattern of the conductive radiator 32 with naked eyes.

Figure 4:
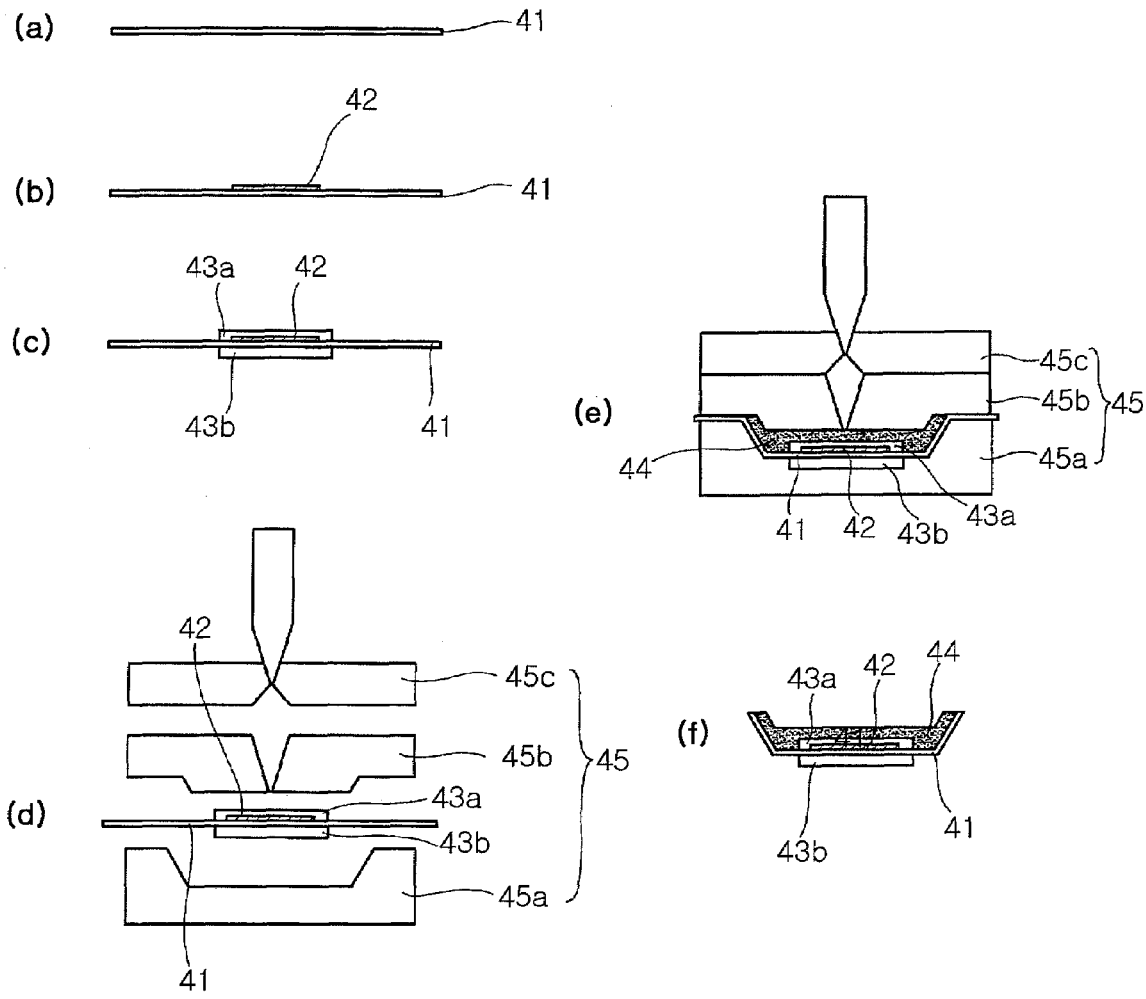
FIG. 4(*a*) to (*f*) are views illustrating a process of fabricating a mobile communication terminal case according to an embodiment of the present invention.

FIG. 4(*a*) to (*f*) are views illustrating a method of fabricating the mobile communication terminal case according to an embodiment of the present invention.

FIG. 4(*a*) illustrates a step of preparing a carrier film 41 made of an insulation material. The radiator of the antenna is patterned on the carrier film 41, which is inserted in a mold for an in-molding process. Thus, it is required that the carrier film 41 is made of a material, which is not largely deformed by the pressure and temperature during the molding process, but can be readily integrated with a mobile communication terminal case. Preferably, the carrier film can be made of a thin polymer material.

FIG. 4(*b*) illustrates a step of forming an antenna radiator 42 on the carrier film 41. The conductive radiator 42 can be formed by attaching a pre-fabricated conductive pattern on the carrier film 41, and printing with a conductive paste or sputtering.

FIG. 4(*c*) illustrates a step of forming a first protective layer 43*a* covering the radiator 42 on the first face of the carrier film 41 and a second protective layer 43*b* on the second face of the carrier film.

It is preferable that the first protective layer 43*a* is made of a material that can prevent X-ray transmission, and is made of Sn as a main material in this embodiment. The first protective layer 43*a* can be composed of one layer or multiple layers.

The second protective layer 43*b* is formed to have a size corresponding to the first protective layer 43*a* formed on the first face of the carrier film.

FIG. 4(*d*) illustrates a step of inserting the carrier film 41 with the radiator 42 and the protective layers 43*a* and 43*b* formed thereon into a mold 45.

The mold 45 is in contact with a part of the carrier film 41 and is composed of a first part 45*a* defining the lower part of the mold, a second part 45*b*, where a molding material is injected, defining the upper part of the mold, and a third part 45*c* connected to a storage of the molding material through a nozzle. The carrier film 41 is inserted between the first part 45*a* and the second part 45*b* of the mold in such a way that the first protective layer 43*a*, which covers the conductive radiator 42 on the carrier film, comes in direct contact with the molding material 44 during the molding process.

FIG. 4(*e*) illustrates a step of assembling all the parts of the mold 45. At this time, the molding material is injected into the space inside the mold 45 at a predetermined pressure through the nozzle. Due to the pressure, the carrier film 41 is transformed into the shape of the first part 45*a* of the mold, and the molding material is injected to fill the space between the second part 45*b* and the first part 45*a* of the mold.

FIG. 4(*f*) illustrates a structure of the carrier film 41 with the conductive radiator 42 and the protective layers 43*a* and 43*b* formed thereon integrated with the mobile communication terminal case, by cooling and curing the molding material injected into the mold 45.

Figure 5:
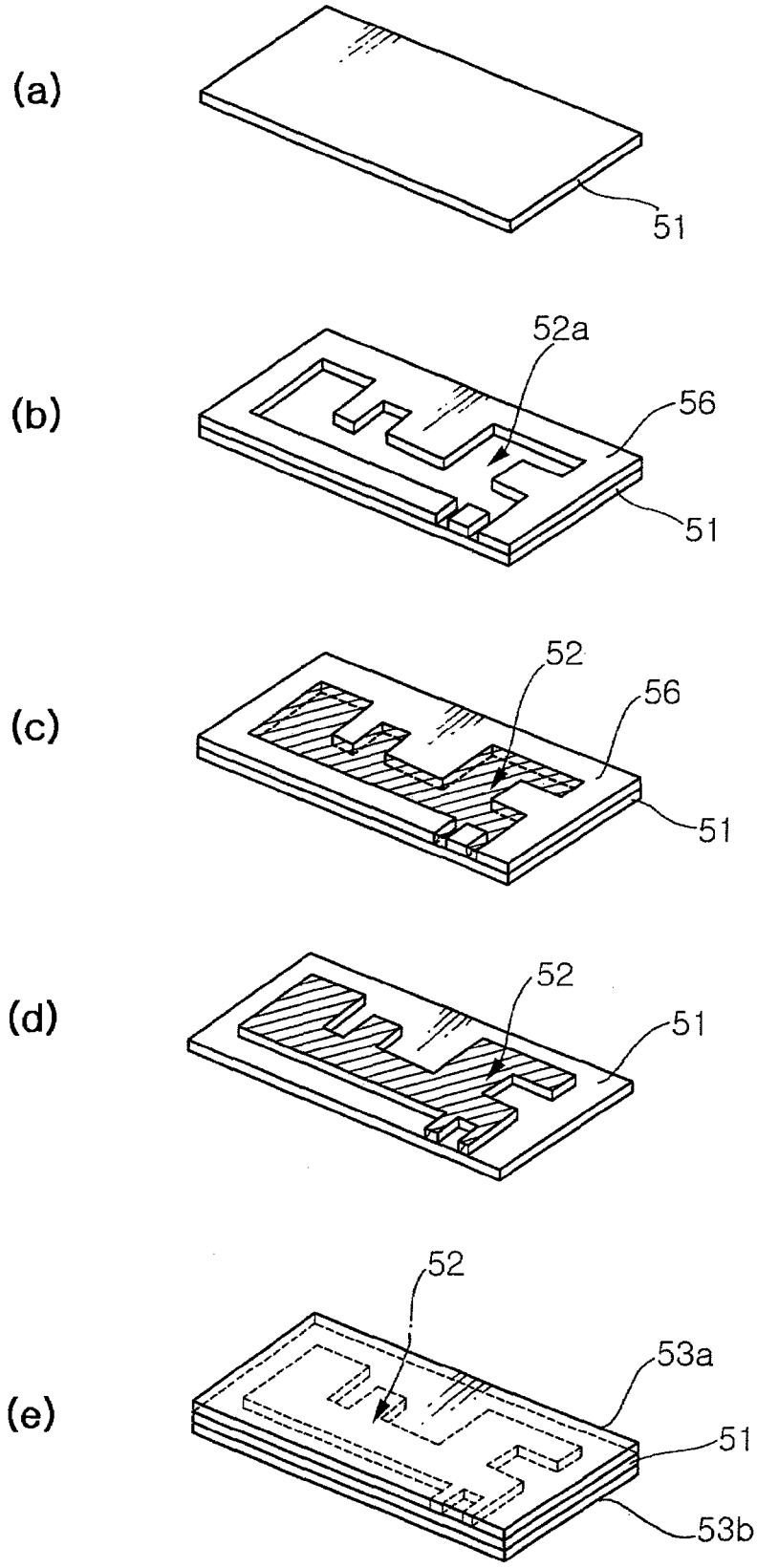
FIG. 5(*a*) to (*e*) are views illustrating a process of fabricating a film type antenna according to an embodiment of the present invention.

FIGS. 5(*a*) and 5(*e*) are views illustrating a process of fabricating the conductive radiator on the carrier film in the course of the method of fabricating the film type antenna according to an embodiment of the present invention.

FIG. 5(*a*) to 5(*e*) illustrate, respectively, a step of preparing the carrier film (FIG. 5(*a*)), a step of attaching a masking tape on the carrier film (FIG. 5(*b*)), a step of forming the radiator on the carrier film by sputtering (FIG. 5(*c*)), a step of removing the masking tape (FIG. 5(*d*)), and a step of forming the first protective layer covering the radiator on the first face of the carrier film and the second protective layer on the second face of the carrier film (FIG. 5(*e*)).

FIG. 5(*a*) illustrates a step of preparing the carrier film 51. Preferably, the carrier film can be made of a thin polymer material.

FIG. 5(*b*) illustrates a step of attaching a masking tape 56 on the carrier film 51. The masking tape 56 has an opening pattern 52*a* cut out in a shape according to the pattern of the conductive radiator, so that the conductive radiator is formed according to the opening pattern 52*a* in the masking tape 56 by a sputtering process.

FIG. 5(*c*) illustrates a sputtering process implemented on the carrier film 51 with a conductive material for forming the radiator.

In the sputtering process, ion beam is irradiated on a target material so that atoms in the target material are dissociated from the target material and deposited on the surface of the carrier film 51, forming the antenna radiator pattern 52.

As described, the sputter target material is composed of a conductive material with purity of more than 99.9%. As a result, the radiator formed on the carrier film by sputtering has the same level of purity as the sputter target material, possessing high electric conductivity.

Therefore, using a conductive ink such as a silver paste can solve the problem of degradation of electric conductivity by the organic substances contained in the paste.

In addition, the sputtered radiator material does not contain organic substances, thus exhibiting very stable chemical resistance. In particular, the conventional screen printing requires using a paste containing a solvent, etc., whereas the method according to this embodiment significantly reduces biologically harmful effects.

FIG. 5(*d*) illustrates a step of removing the masking tape 56 to form the conductive radiator 52 on the carrier film 51. The masking tape 56 can be removed by applying physical force.

FIG. 5(*e*) illustrates a step of forming the first protective layer 53*a* and the second protective layer 53*b* on opposed faces of the carrier film.

Each of the protective layers 53*a* and 53*b* can be formed in a single layer or multiple layers.

In the case of forming the protective layer in multiple layers, a lower layer can be formed as an intermediate layer for forming a plating layer, a Sn plating layer can be formed on the lower layer, and an upper layer can be formed on the Sn layer to protect the Sn layer.

As set forth above, the present invention provides a film antenna which can be mounted integrally with a mobile communication terminal to minimize a mounting area and protect a unique pattern of a radiator, and a mobile communication terminal using the same.

While the present invention has been shown and described in connection with the exemplary embodiments, it will be apparent to those skilled in the art that modifications and variations can be made without departing from the spirit and scope of the invention as defined by the appended claims.

What is claimed is:

1. A film type antenna, comprising:

a carrier film comprising an insulation material, the carrier film having first and second faces defining a thickness therebetween;

a conductive radiator formed on the first face of the carrier film; and a first protective layer covering the radiator on the first face of the carrier film, the first protective layer containing a material obstructing X-ray transmission.

2. The film type antenna according to claim 1, further comprising a second protective layer formed on the second face of the carrier film, corresponding to the first protective layer.

3. The film type antenna according to claim 2, wherein the first and second protective layers comprise the same material.

4. The film type antenna according to claim 1, wherein the first protective layer comprises Sn as a main material.

5. The film type antenna according to claim 1, wherein the first protective layer has the same color as the conductive radiator.

6. The film type antenna according to claim 1, wherein the first protective layer comprises:

an electrically insulating lower layer;

a Sn plating layer formed on the lower layer; and an electrically insulating upper layer formed on the Sn plating layer.

7. A mobile communication terminal case, comprising:

a film type antenna comprising a carrier film made of an insulation material, the carrier film having first and second faces defining a thickness therebetween, a conductive radiator formed on the first face of the carrier film, and a first protective layer covering the radiator on the first face of the carrier film, the first protective layer containing a material obstructing X-ray transmission; and a case structure with the film type antenna attached on a surface thereof, wherein the radiator is disposed between the case structure and the carrier film.

8. The mobile communication terminal case according to claim 7, further comprising a second protective layer formed on the second face of the carrier film, corresponding to the first protective layer.

9. The mobile communication terminal case according to claim 8, wherein the first and second protective layers comprise the same material.

10. The mobile communication terminal case according to claim 7, wherein the first protective layer comprises Sn as a main material.

11. The mobile communication terminal case according to claim 7, wherein the first protective layer has the same color as the conductive radiator.

12. The mobile communication terminal case according to claim 7, wherein the protective layer comprises:

an electrically insulating lower layer;

a Sn plating layer formed on the lower layer; and an electrically insulating upper layer formed on the Sn plating layer.

13. A method of fabricating a mobile communication terminal case comprising:

preparing a carrier film made of an insulation material, the carrier film having first and second faces defining a thickness therebetween;

forming a conductive radiator on the first face of the carrier film;

forming a first protective layer covering the radiator on the first face of the carrier film;

inserting the carrier film with the radiator and the first protective layer formed thereon into a mold having a shape of a case structure; and injecting a molding material into the mold to form a case structure integrated with the carrier film.

14. The method according to claim 13, further comprising prior to said inserting forming a second protective layer with the same material as the first protective layer on a portion of the second face of the carrier film that corresponds to the conductive radiator formed on the first face.

15. The method according to claim 13, wherein the conductive radiator is formed by a sputtering process.

16. The method according to claim 13, wherein a first protective layer is formed by:

forming an electrically insulating lower layer on the carrier film to cover the conductive radiator;

forming a Sn plating layer on the electrically insulating lower layer; and forming an electrically insulating upper layer on the Sn plating layer.

17. A method of fabricating a mobile communication terminal case comprising:

forming a conductive radiator on a first face of a carrier film, wherein the carrier film further has a second face opposite to the first face and defining with the first face a thickness of said carrier film, and the carrier film is made of an insulation material;

forming a first protective layer covering the radiator on the first face of the carrier film;

inserting the carrier film with the radiator and the first protective layer formed thereon into a mold having a shape of a case structure; and injecting a molding material into the mold to form a case structure integrated with the carrier film, wherein the first protective layer contains a material obstructing X-ray transmission.

18. The method according to claim 17, further comprising prior to said inserting forming a second protective layer with the same material as the first protective layer on a portion of the second face of the carrier film that corresponds to the conductive radiator formed on the first face.

19. The method according to claim 17, wherein the conductive radiator is formed by a sputtering process.

20. The method according to claim 17, wherein a first protective layer is formed by:

forming an electrically insulating lower layer on the carrier film to cover the conductive radiator;

forming a Sn plating layer on the electrically insulating lower layer; and forming an electrically insulating upper layer on the Sn plating layer.

* * * * *